United States Patent [19]

Breslow

[11] 3,945,643

[45] Mar. 23, 1976

[54] BOARD GAME APPARATUS

[75] Inventor: Jeffrey D. Breslow, Highland Park, Ill.

[73] Assignee: Marvin Glass & Associates, Chicago, Ill.

[22] Filed: May 16, 1975

[21] Appl. No.: 578,005

[52] U.S. Cl...... 273/134 B; 273/134 C; 273/134 AT

[51] Int. Cl.$^2$..... A63F 3/00

[58] Field of Search..... 273/134

[56] References Cited

UNITED STATES PATENTS

| | | | |
|---|---|---|---|
| 1,635,734 | 7/1927 | Ziegler | 273/134 AC |
| 1,674,866 | 6/1928 | Klein | 273/134 AD |
| 3,831,946 | 8/1974 | Denalsky | 273/134 AD |

*Primary Examiner*—Delbert B. Lowe

*Attorney, Agent, or Firm*—Coffee & Sweeney

[57] ABSTRACT

A board game apparatus wherein the object is to collect the greatest number of playing pieces which are awarded to the players of the game for correctly answering a riddle by movement of pieces over a gameboard. The apparatus generally includes a gameboard having a playing surface thereon, a movable playing piece for each player of the game, a set of playing pieces acquired by the players during play of the game and carrying indicia thereon, a plurality of stations on the gameboard defining a playing piece path of travel or track on the playing surface, and a chance device for determining the advancement of the players' playing pieces along the track. The indicia on the set of acquired playing pieces comprises questions or riddles for the players of the game. Each station includes indicia thereon representing an answer to one of the questions presented by the indica on the acquired playing pieces. A question is answered by a player being first to move to the proper answer station and that player is awarded the playing piece having the corresponding question indicia thereon. The gameboard includes a dispensing device in the form of an ice cream truck for dispensing the acquired playing pieces to the players of the game, the acquired playing pieces being in the form of ice cream sticks.

8 Claims, 3 Drawing Figures

BOARD GAME APPARATUS

BACKGROUND OF THE INVENTION

1. Field of the Invention

The present invention relates to board games and more particularly to a board game wherein the object is to collect the greatest number of "question" playing pieces which are awarded to a player who correctly answers, by movement over the gameboard, a riddle posed by indicia on the question playing piece.

2. Brief Description of the Prior Art

Board games have enjoyed a great deal of popularity, particularly among children, throughout the years. One form of board game which has been popular is the type in which the object is to accumulate wealth in the form of simulated money, or the like. However, most of these board games have relied, for the most part, solely on an element of chance for determining the manner and the amount of simulated money acquired by a player. Therefore, a need and desire has arisen for a new and improved board game which, in addition to relying on chance, also requires an amount of strategy and thoughtfulness of the players of the game.

SUMMARY OF THE INVENTION

An object of the present invention is to provide a new and entertaining board game using a plurality of riddles or questions which are posed by question playing pieces and answered by indicia printed on the gameboard.

These and other objects of the invention are accomplished in one embodiment currently contemplated which provides a gameboard having a playing surface thereon, a plurality of movable playing pieces, at least one for each player of the game, a plurality of stations on the gameboard to form a track defining a playing piece path of travel, and a chance device for determining the advancement of the playing pieces along the track. In the preferred embodiment, there is provided a set of question playing pieces having indicia thereon posing a question to the players of the game and "answer" indicia on the gameboard stations which answer the questions or riddles posed by the question playing pieces.

Other objects, features and advantages of the invention will be apparent from the following detailed description taken in connection with the accompanying drawings.

DESCRIPTION OF THE PREFERRED EMBODIMENT

Figure 1:
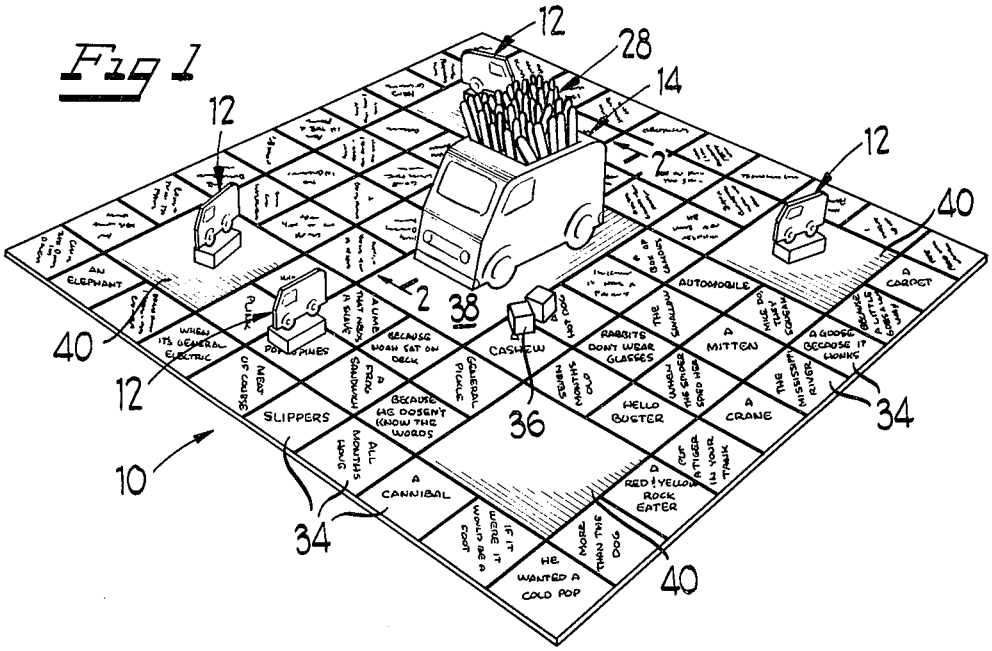
FIG. 1 is a perspective view of the board game apparatus embodying the concepts of the present invention.

The board game apparatus of the present invention includes a gameboard, generally designated 10 (FIG. 1), a plurality of movable playing pieces, generally designated 12 (one for each player of the game), and a dispensing device, generally designated 14. In the present embodiment, each movable playing piece 12 is in the shape of a two-dimensional toy truck 16 (FIG. 3), such as an ice cream dispensing truck, mounted on a block 18 to permit the truck 16 to stand upright and be moved over the gameboard.

Figure 2:
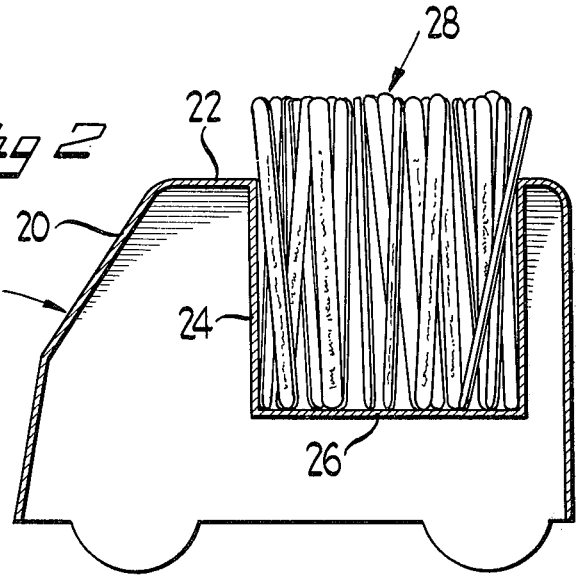
FIG. 2 is a vertical section, on an enlarged scale, through the question playing piece dispensing device, taken generally along line 2-2 of FIG. 1.

The dispensing device 14 (referring to FIG. 2) includes an outer shell 20, the contours of which define a toy ice cream dispensing truck. A cavity is defined in the top 22 of the truck by a plurality of depending generally vertical walls 24 and a bottom wall 26 for receiving a set of question playing pieces, generally designated 28.

The playing pieces 28 each are in the shape of an ice cream stick, such as the type used for serving ice cream bars. Each of the question playing pieces 28 includes indicia 30 thereon which poses a question or riddle to the players of the game, for use as will be described in detail hereinafter.

The gameboard 10 includes a plurality of stations 34 thereon which define a path of travel for the playing pieces 12. A playing piece 12 may move, on a player's turn, to any adjacent station 34 and to subsequent adjacent stations according to the number of stations a playing piece is permitted to move as determined by a roll of a pair of dice 36. The gameboard includes a large, generally rectangular, area 38 in the center thereof for placement of the dispensing device 14, and four slightly smaller open areas 40 thereabout which define the starting positions for the players' movable playing pieces 12 at the beginning of the game. Each station 34 includes indicia thereon representative of a correct answer to a question or riddle posed by at least one of the question playing pieces 28.

In one scheme of play, each of the playing pieces, from two to four, is placed on a starting position 40 and one of the players, determined at random, selects one of the playing pieces 28 from the dispensing device 14. That player reads the question or riddle imprinted thereon and the remaining players, in succession, roll the dice 36 in an attempt to move to the particular station 34 carrying indicia representative of the correct answer to the riddle. The player who first arrives at the correct answer station 34 is awarded the corresponding question playing piece 28. Thereafter, the next player selects a playing piece 28 and the remaining players attempt to seek the correct answer.

As can be seen from the drawings, in the exemplary embodiment, at the beginning of the play of the game, when all of the playing pieces 12 are at the starting positions 40, each player has a minimum of eight stations to which he can move directly across a bounding line for the station, and a maximum of twelve stations if diagonal movements are permitted under the rules. According to the dictates of the rules, the game is over when a predetermined number or all of the playing pieces 28 have been acquired by the players, and the player who has accumulated the most playing pieces 28 is declared the winner.

Figure 3:
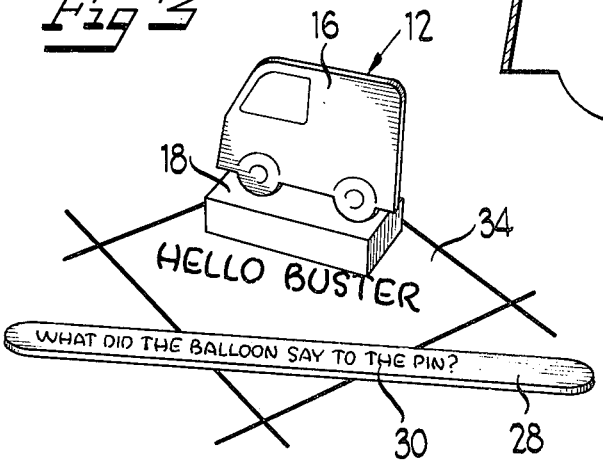
FIG. 3 is a fragmentary perspective view, on an enlarged scale, showing an answer station having indicia representative of a correct answer to a question presented by a corresponding question playing piece, along with a player's movable playing piece.

FIG. 3 shows a complementary combination of a question (or riddle) playing piece 28 and the corresponding answer station 34 having a movable playing piece 12 positioned thereon. In other words, the proper answer to the riddle "What did the balloon say to the pin?" on the shown question playing piece 28 is the answer "Hello Buster" on the station 34. In this manner, not only does chance (dice 36) play a role in the game, but the players must also figure out the proper answer to the riddle. Further ingenuity would be required if a player must have the correct number of station moves, corresponding to the numbers on the dice, to land on a particular answer station. Thus a player also would have to determine his proper path of travel.

The foregoing detailed description has been given for clearness of understanding only and no unnecessary limitations should be understood therefrom as some modifications will be obvious to those skilled in the art.

I claim:

1. A board game apparatus comprising:

a gameboard having a playing surface thereon;

a first set of movable playing pieces, at least one for each player of the game, for movement over said playing surface;

a second set of question playing pieces, at least some of which have indicia thereon including a question or riddle to be solved by the players of the game;

a plurality of stations on the playing surface of the gameboard defining a playing piece path of travel, including answer stations having indicia thereon indicating a proper answer to the riddle on at least one of said question playing pieces, said one question playing piece thus being awardable to a player should his movable playing piece land on the proper answer station; and means for determining how many stations a particular movable playing piece is to be moved by a player along said path of travel defined by said stations.

2. The board game apparatus of claim 1 wherein said path of travel is open whereby each movable playing piece can be moved more than one adjacent station.

3. The board game apparatus of claim 1 including a dispensing device having means for storing and dispensing the question playing pieces.

4. The board game apparatus of claim 3 wherein said storage means substantially covers the indicia on the question playing pieces when placed therein.

5. The board game apparatus of claim 3 wherein said dispensing device is in the form of a toy ice cream truck.

6. The board game apparatus of claim 5 wherein said question playing pieces are in the form of ice cream sticks having the question or riddle indicia thereon.

7. A board game apparatus, comprising:

a gameboard having a playing surface thereon;

a set of movable playing pieces in the form of miniature trucks, at least one for each player of the game for movement over said playing surface;

a set of playing sticks, at least some of which have indicia thereon indicating a question to be solved by the players of the game;

a plurality of stations on the gameboard defining a playing piece path of travel, including match stations having indicia thereon representative of an answer to the question on at least one of said playing sticks, said one playing stick thus being awardable to a player whose playing piece lands on that particular match station;

a dispensing device in the shape of a miniature truck having a means therein for storing and dispensing said playing sticks; and means for determining how many stations a particular playing piece is to be moved by a player along said path of travel.

8. The board game apparatus of claim 7 wherein said storage means substantially covers the indicia on the "question" playing pieces when placed therein.

* * * * *